US005522160A

United States Patent [19]

Hyppanen

[11] Patent Number: 5,522,160

[45] Date of Patent: Jun. 4, 1996

[54] FLUIDIZED BED ASSEMBLY WITH FLOW EQUALIZATION

[75] Inventor: Timo Hyppanen, Karhula, Finland

[73] Assignee: Foster Wheeler Energia Oy, Karhula, Finland

[21] Appl. No.: 368,587

[22] Filed: Jan. 5, 1995

[51] Int. Cl.[6] ..... F26B 17/00

[52] U.S. Cl. ..... 34/589

[58] Field of Search ..... 34/578, 589, 370; 122/40; 165/104.16; 432/58; 110/245

[56] References Cited

U.S. PATENT DOCUMENTS

| | | | |
|---|---|---|---|
| 3,002,289 | 10/1961 | Nielsen | 34/589 |
| 4,591,324 | 5/1986 | Kubota | 34/589 |
| 5,198,029 | 3/1993 | Dutta et al. | 34/589 |
| 5,218,932 | 6/1993 | Abdulally . | |
| 5,332,553 | 7/1994 | Hyppannen | 34/578 |

OTHER PUBLICATIONS

"Solids Flow Pattern and Heat Transfer in an Industrial–Scale Fluidized Bed Heat Exchanger" by Werdemann Cord, C. and Werther Joachim, *Fluidized Bed Combustion*, vol. 2, ASME 1993, pp. 985–990.

"Bed Ash Cooling and Removal Systems" by Modrak Thomas, M. Henschel Kay, J. Carmine Gagliardi, R and Dicker John, M., *Fluidized Bed Combustion*, vol. 2, ASME 1993, pp. 1325–1331.

*Primary Examiner*—John T. Kwon
*Attorney, Agent, or Firm*—Nixon & Vanderhye

[57] ABSTRACT

A fluidized bed assembly, such as an ash cooler, includes first and second fluidized bed chambers each having a bottom portion and side walls. Fluidizing gas is introduced into the bottom portions to fluidize particulates within the chambers. A flow equalizer (such as a barrier having a number of openings associated with it) separates the chambers and provides a substantial uniform flow of particulates from the first chamber to the second chamber so that no dead spots or corners form in the chambers adjacent the flow equalizer. Heat exchanger components are typically provided in the barrier for circulating heat exchange fluid through the barrier. Also, heat exchangers are provided in one or both of the chambers to cool the particulates. The particulates mix in the second chamber, and after cooling may be recirculated to a gasifier/combustor for supplying ash to the first chamber. A classifier chamber is connected between the reactor and the first chamber. Fluidizing gas may be returned from the chambers to the reactor.

30 Claims, 6 Drawing Sheets

FLUIDIZED BED ASSEMBLY WITH FLOW EQUALIZATION

BACKGROUND AND SUMMARY OF THE INVENTION

The present invention relates to a fluidized bed assembly with at least a first and a second fluidized bed chamber, each chamber having side walls and a bottom portion with means for introducing fluidization gas into the chamber. The present invention also relates to a fluidized bed cooler having walls defining an interior of a cooler chamber, and a bottom section with means for introducing fluidization gas into the cooler chamber. In such a cooler fine solid material is cooled in a fluidized state.

The invention also relates to a method of processing solid particulate material in a fluidized bed apparatus, such as a cooler, including at least two fluidization chambers, using a flow equalizer dividing the chambers, and extracting heat from the solid particulate in the fluidized bed.

There are several situations in fluidized bed reactors [such as circulating fluidized bed combustors or gasifiers, or even circulating fluidized bed gas coolers/solid preheaters] when a need arises for passing solid particulate material from one chamber to another, such as in cooling the circulating material to a certain level in a separate fluidized bed cooler. For example, when ash is being treated during discharging of the ash from the process and conveying it to a further processing location, it is necessary to set certain limits on the ash temperature; i.e., the ash must be cooled prior to its further handling. Such processing also minimizes heat loss from the assembly and increases reactor efficiency, by recovering heat.

U.S. Pat. No. 5,218,932 discloses a fluidized bed reactor and a method of operating it in which a bed of particulate material including fuel is formed in a furnace section. A stripper/cooler is located adjacent to the furnace section for receiving particulate material from the furnace section. The particulate material is first passed to the stripper section where air is supplied through the particulate material at a velocity sufficient to entrain relatively fine-grained portions of the particulate material. A plurality of spaced baffle members are disposed in the stripper section for acting on the entrained particulates to separate them from the air. The particulate material in the stripper section is passed to the cooler section in which air is passed through the particulate material at a velocity sufficient to cool the particulate material and entrain relatively fine-grained portions of the particulate material therewith. A second plurality of spaced baffle members is disposed in the cooler section for acting on the entrained particulates to separate them from the air. A drain pipe communicates with the cooler section for removing the particulate material from the reactor. The cooler section is divided into several sections by partition walls, the walls having openings at their opposite lower corners to enable the fluidized particulate material to move into the following section. This arrangement results in insufficient mixing of particulate material in the cooler section.

The article "Solids Flow Pattern and Heat Transfer in an Industrial-Scale Fluidized Bed Heat Exchanger" by Werdemann Cord, C. and Werther Joachim, *Fluidized Bed Combustion,* Vol. 2, ASME 1993, pp. 985–990, discloses a fluidized bed heat exchanger (FBHE) connected with a circulating fluidized bed (CFB) reactor. The FBHE is suggested to be formed by several chambers separated by solid partition walls. The movement of solids into successive chambers is designed to take place by overflow of the solids. This arrangement as well results in insufficient mixing of solids.

The article "Bed Ash Cooling and Removal Systems" by Modrak Thomas, M., Henschel Kay, J., Carmine Gagliardi, R. and Dicker John, M., *Fluidized Bed Combustion,* Vol. 2, ASME 1993, pp. 1325–1331 discloses a fluidized bed ash cooler (FBAC)in which the chamber is divided into sections with partition walls having an opening at their lower corners for solids to pass into the following section.

It has been discovered that the mixing of solids is insufficient in structures such as described above. Also, dead spaces or corners easily remain in such structure which hampers the heat transfer efficiency of the cooler resulting in unnecessary space and material consumption.

According to the present invention a method of and an apparatus for processing solid material in a fluidized bed apparatus are provided in which the above described drawbacks are eliminated, providing effective cooling of solids in association with a fluidized bed reactor.

In connection with this application the term "multiple solid flow" refers to a movement of fluidized solid material which approaches the movement of an equal flow velocity profile solid material in the movement direction.

According to a first aspect of the present invention a fluidized bed assembly is provided which comprises first and second fluidized bed chambers, each of the chambers having a bottom portion and side walls. Means are provided (such as a conventional grid, windbox, or the like) for introducing fluidizing gas into each of the bottom portions to fluidize particulates in the chamber. A flow equalizer separates the first and second chambers and provides a substantially uniform passage of particulates from the first chamber to the second chamber so that no dead spots or corners form in the chambers adjacent the flow equalizer.

Preferably at least one of the first and the second chambers includes heat transfer means immersed in the fluidized bed in the fluidized bed chamber and means for discharging gas from the fluidized bed chamber. Depending on the application only one or both of the first and second chambers may include heat transfer means. The heat transfer means may be, for example, evaporators, steam superheating or reheating devices, or feed water preheating or air preheating heat exchangers.

According to another aspect of the present invention the solid material flow equalizer comprises a barrier having at least two distinct openings spaced a predetermined distance from each other, the barrier providing preferably <30% open area of the cross sectional area of the fluidized bed chambers at the barrier. Surprisingly, it has been discovered that a favorable result is obtained if the solid material flow equalizer comprises a wall or the like with at least two distinct openings spaced a distance from each other which is at its shortest 10–50% of the square root of the total area of the wall, and if the openings provide <30% open area of the cross sectional area of the fluidized bed chambers. Optimization of openings may be obtained as follows: With the letter N referring to the number of distinct openings (N being an interger >2), the distance between the openings is preferably defined to be between 1/N and ½ of the square root of the surface area of the wall.

According to yet another aspect of the present invention the solid material flow equalizer comprises a wall or the like with substantially evenly spaced openings. The wall may be a perforated wall with substantially evenly spaced openings. Preferably the openings are such that their largest diameter is <50 mm.

Also, it has been noted to be favorable in some situations for the solid material flow equalizer to comprise a wall or like having a border zone with a width of 0.1 m at the periphery and openings in the wall.

The flow equalizer preferably comprises a barrier at the interface between the first and second chambers. The barrier has at least two openings associated therewith, preferably a plurality of substantially uniformly spaced openings, so that dead corners or spots are avoided. The barrier may be formed by a substantially continuous wall (generally planar in configuration) with through extending openings which may be perforations, quadrate in shape, or formed in a variety of other different forms. Alternatively the barrier may be formed by a number of obstacles which are independent from each other (or at least independent of some of the other obstacles) and mounted so that there are spaces between them, the spaces forming the openings. In either case heat exchange elements may be provided in the barrier for cooling particulates flowing through openings in the barrier.

According to yet another aspect of the present invention the fluidized bed apparatus may serve as a solid material cooler, wherein the cooling chambers or regions are separated from each other so that a chamber may be maintained at a certain temperature level substantially independently from other chambers. In practice this means that the adjacent fluidized beds are limited in their particle exchange at least backwards, i.e. at the border area of the zone chambers only unidirectional movement is desired, however, backflow to some extent is almost unavoidable. Excessive particle exchange is prevented, according to the present invention, by providing the solid equalizer (as described above) between the chambers, which equalizer preferably covers greater than 50% of the cross sectional area of said fluidized bed cooler at the border zone of the chambers.

The invention also comprises a fluidized bed assembly having first and second fluidized bed chambers, each chamber having a bottom portion and side walls, a means for introducing fluidizing gas into each of the bottom portions to fluidize particulates in the chambers. The assembly further comprises a barrier at the interface between the first and second elements, the barrier including at least two distinct openings spaced a distance from each other. That distance is, at its shortest, 10–50% of the square root of the area of the barrier, and the openings provide less than 30% open area at the cross sectional area at the interface between the first and second chambers.

According to yet another aspect of the present invention a method of processing solid particulate material in a fluidized bed including first and second fluidization chambers, and an interface therebetween, is provided. The method comprises the following steps: (a) Fluidizing solid particulate material in the first chamber. (b) Fluidizing solid particulate material in the second chamber. (c) Passing solid particulate material from the first chamber to the second chamber in at least two parallel distinct flows to substantially evenly introduce solid particulate material from the first chamber into the second chamber, so that there are no dead spots or corners adjacent the interface. And (d) uniformly mixing the distinct parallel flows of solid particulate material in the second chamber. Step (c) may be practiced by providing a flow equalizer barrier with at least two uniformly spaced openings between the first and second chambers. There is also preferably the further step of cooling the barrier to in turn cool solid particulate material passing through the openings, typically recovering heat from the solid particulate material.

It is the primary object of the present invention to provide effecting mixing of particulate materials during cooling in fluidized bed chambers, and uniform flow of particulate material from one chamber to another so that dead spots or corners are avoided. This and other objects of the invention will become clear from an inspection of the detailed description of the drawings and from the appended claims.

DETAILED DESCRIPTION OF THE DRAWINGS

Figure 1:
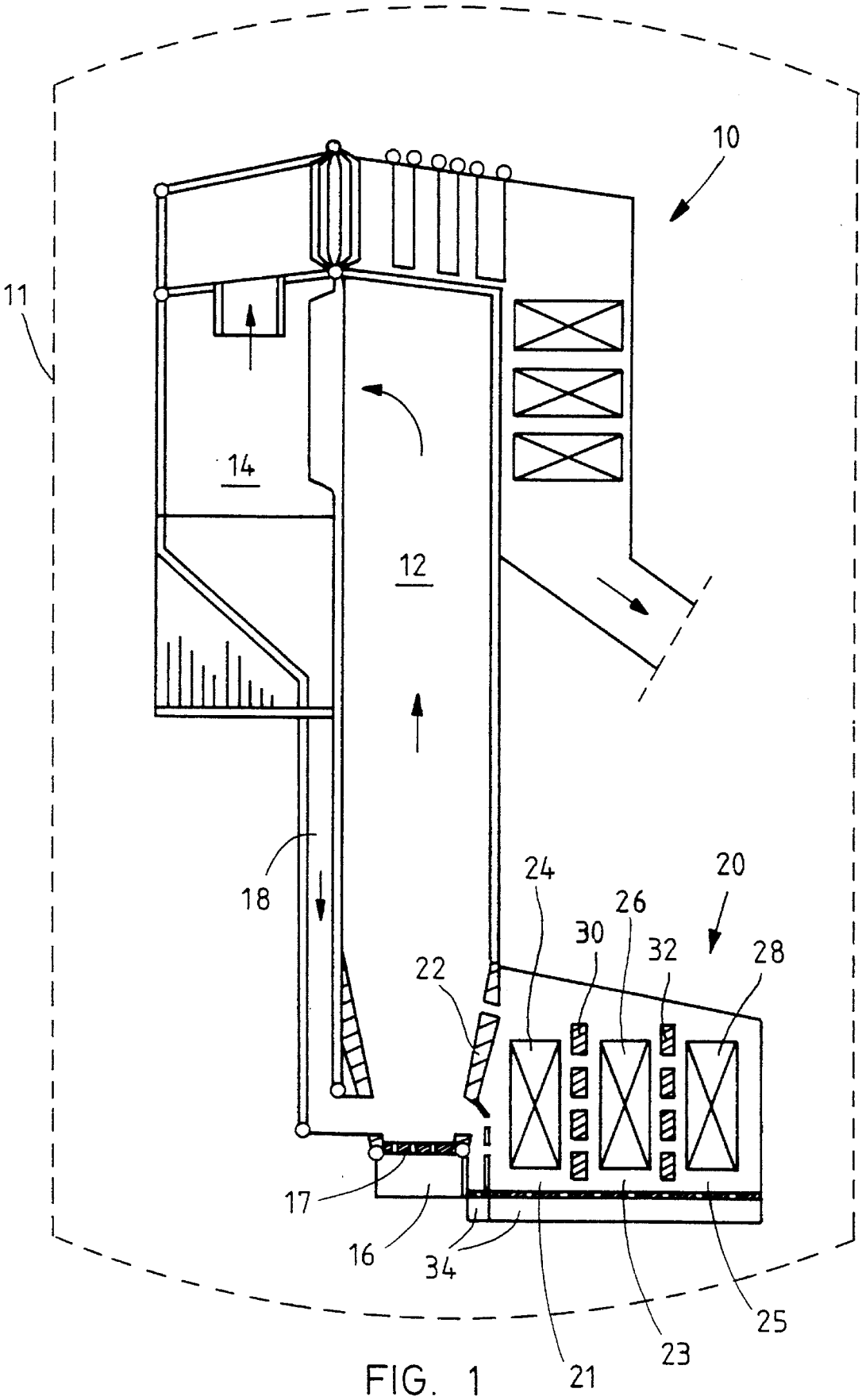
FIG. 1 is a side schematic cross sectional view illustrating a circulating fluidized bed reactor with a multi-chamber fluidized bed cooler according to the present invention.

FIG. 1 illustrates a circulating fluidized bed reactor 10 having a reaction chamber 12 and a solid material separator 14. The circulating fluidized bed reactor 10 may also be provided as a pressurized (i.e. at superatmospheric pressure, preferably 1.5 bar or higher pressure) fluidized bed reactor 10 enclosed by a pressure vessel, illustrated by dotted line 11 in FIG. 1.

Fluidization gas is introduced by means 16 (e.g. a "windbox") through a bottom grid 17 into the reaction chamber 12 to fluidize the solid particulate material (preferably including fuel, inert material and/or absorbent) in the chamber 12 to such an extent that a considerable portion of the solid material is entrained with the gases flowing upwardly and out of the chamber 12 to the separator 14. Solid material is separated from the gases in separator 14 (e.g. a centrifugal separator) which are led out of the reactor 10, and the separated solids are at least partially recycled back to the chamber 12 via a return duct 18.

When the reactor 10 operates, e.g., as a combustor of fuel material, unburned substances are formed which must be discharged from the reactor chamber 12. The unburned substances are usually of such a large grain size that they cannot be fluidized, but must be discharged from the bottom of the chamber 12. A fluidized bed processing assembly is provided at the lower portion of the circulating fluidized bed reactor 10 which assembly preferably serves as a cooler 20 for handling the unburned substances. The cooler 20 is preferably provided with a common wall section 22 with the reaction chamber 12. The fluidized bed cooler 20 comprises fluidized bed heat exchanger chambers 21, 23, 25 having heat transfer elements 24, 26, 28, respectively. Flow equalizers 30, 32 are provided between the heat exchange elements 24, 26, 28 of the chambers 21, 23, 25. The fluidized bed cooler 20 is also provided with gas supply means 34 for introducing fluidization gas into each chamber 21, 23, 25

(e.g., a windbox with grid, or other conventional fluidization device).

Figure 2:
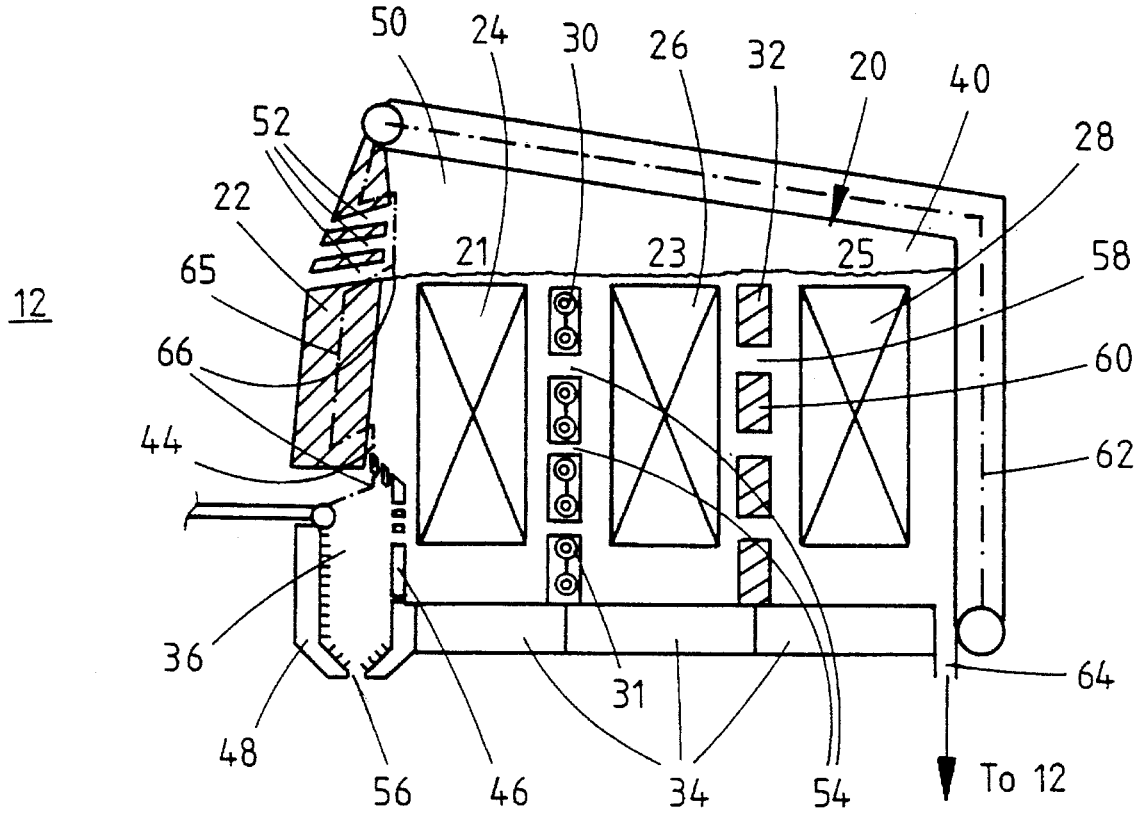
FIG. 2 is a side cross sectional detailed view of a modified form of the cooler of FIG. 1.

The operation of the fluidized bed cooler 20 is explained more in detail in connection with FIG. 2 which is another exemplary embodiment of a fluidized bed serving as a cooler 20 as shown in FIG. 1. The fluidized bed cooler 20 of FIG. 2 comprises a fluidized bed heat exchanger having heat transfer elements 24, 26, 28 and solid flow equalizers 30, 32 between the heat transfer chambers 21, 23, 25. The fluidized bed cooler 20 is also provided with gas supply means 34 for introducing fluidization gas. Separately controlled gas introduction (i.e. a different control for each chamber 21, 23, 25) is preferred, e.g. provided by different automatically controlled flow regulating valves.

Solid material, such as bottom ash, is introduced into the fluidized bed cooler 20 from the circulating fluidized bed reactor 12 via a classifier chamber 36 which allows only solids having a predetermined grain size to enter the first chamber 21 of the fluidized bed cooler 20. In this way the possibility of blockage is minimized. The classifier chamber 36 communicates with the first chamber 21 through a plurality of openings 44 in a partition wall section 46. The openings 44 are designed to allow the passage of gases, introduced via a plenum 48, into the fluidized bed cooler 20, as well as the passage of substantially fine solids entrained with the gases.

The temperature of the solids introduced into the classifier chamber 36 is approximately 800°–1200° C. where the fluidized bed reactor chamber 12 is used as a fuel combustor or a gasifier. In the classifier chamber 36 larger particles which could cause blockage in the fluidized cooler 20 are drained out via an outlet 56. Gas fed by means 48 may be selected appropriately to also dilute any corrosive substance. Solids are fed into the first chamber 21 wherein they are fluidized by gas supplied by individually controllable gas source 34. Solids are mixed efficiently in the first chamber 21, thus heat transfer by the heat exchangers 24 is also efficient. Fluidization gases introduced at 34 may enter the gas volume 50. Via openings 52 into the reactor chamber 12, small particles may also be transported by the gases introduced at 34 into the reactor chamber 12.

In the fluidized bed cooler according to the present invention the passing of solids from the first chamber to the second is not primarily based on overflow. Rather, a barrier 30 serving as a solid flow equalizer is disposed at the interface between the first chamber 21 and the second chamber 23 of the fluidized bed cooler 20. The solid flow equalizer 30 preferably comprises a cooled substantially planar wall with substantially equally spaced openings 54 (see FIGS. 2 and 3) in the wall. The amount of the open area (provided by openings 54) should be sufficient to allow the particulate material to pass into the subsequent chamber 23 at a desired rate, however the open area should also be small enough to establish a multiple solid flow in the concept of the present invention. Ideally it is preferred that a substantially equal flow rate of solids passing through all openings 54 is provided. In this manner any dead corners or spots are avoided. The open area in the solid flow equalizer 30 is <50%, preferably <30%, of the total cross sectional area of the interface between the chambers 21, 23. The equalizer 30 also preferably covers greater than 50% of the cross sectional area of the cooler 20 at the border (interface) of chambers 21, 23 (see FIG. 2).

Preferably N openings 54 are provided, where N is an integer greater than 2. The openings 54 are spaced a distance which is 1/N–½ of the square root of the surface area of the barrier 30.

Figure 3:
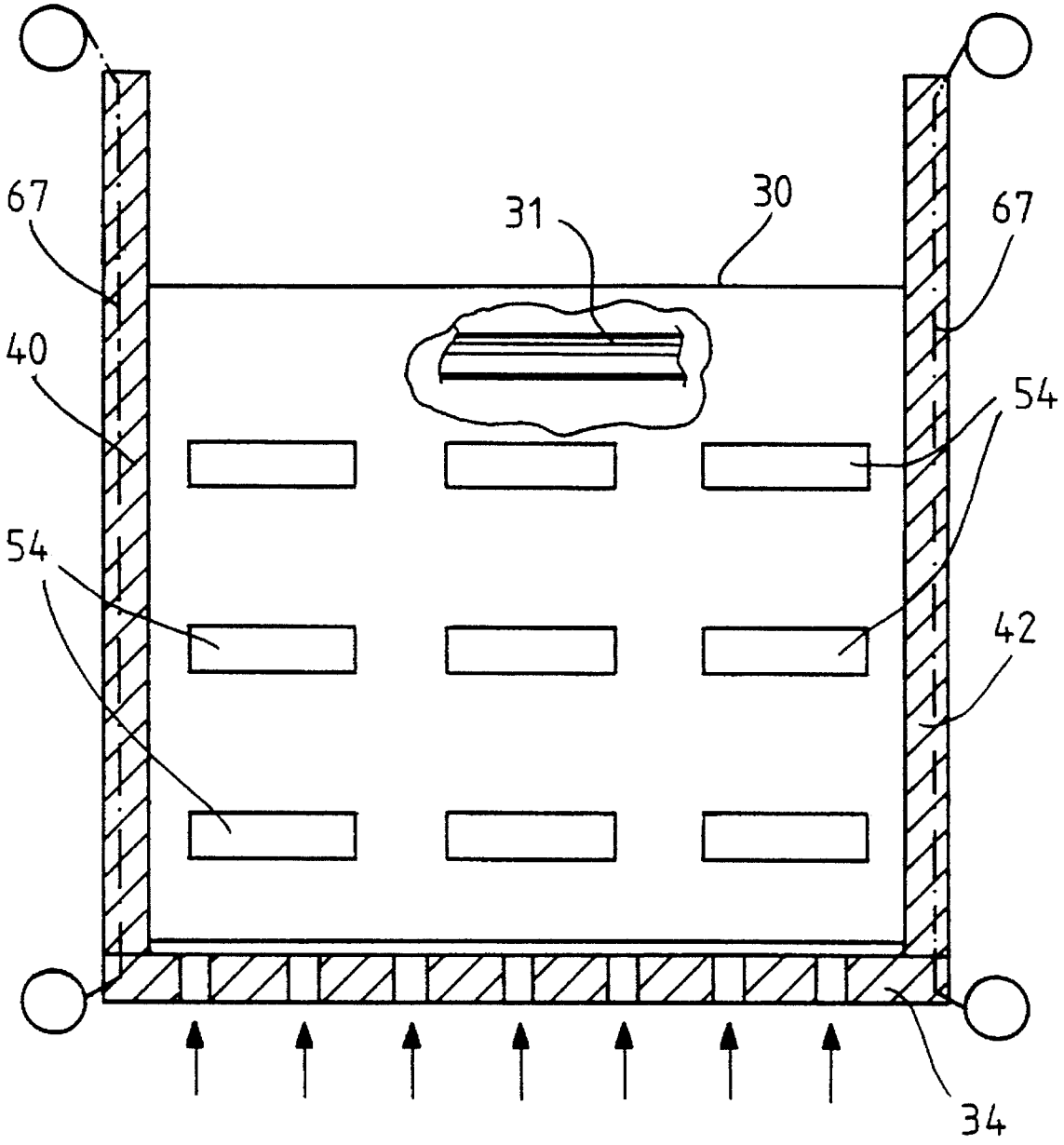
FIG. 3 is a front view of the barrier between the first and second chambers of the cooler of FIG. 2, with a portion of the barrier cut away to illustrate the heat exchange element therein.

Cooling of the barrier 30 by providing heat exchange tubes 31 conveying heat transfer medium (e.g. water, steam, etc.) through barrier 30 may be effected. The tubes 31 are preferably connected to a steam generation system of the fluidized bed reactor 12. FIGS. 2 and 3 disclose horizontal tubes 31, but the tubes 31 may also be vertically oriented, specifically in steam generation with natural circulation evaporation.

According to the present invention, since the passage of solid particulate material from the first chamber 21 to the second chamber 23 is practiced via the flow equalizer 30 as a multiple solid flow, in at least two parallel flows, the temperature of the first chamber 21 settles to a certain value while heat is transferred from the material. The heat exchanger 24 may be provided with, e.g. a panel or a tube-type heat exchanger for heating steam or evaporating water, for example.

The temperature in the second chamber 23 is controlled by heat exchangers 26 so as to be maintained lower than in chamber 21. Again, due to the multiple solid flow of the solids, the temperature of the second chamber 23 settles to a value which is substantially equal in all regions of the bed in chamber 23 in steady state conditions while heat is transferred from the solids to the heat exchanger 26. In practice this means that the first and second fluidization chambers 21, 23, heat transfer means 24, 26, and means for introducing fluidization gas 34, form a staged fluidized bed cooler (20).

The second barrier 32 separates the second and the third chambers 23, 25 from each other. The barrier 32 may be formed of several distinct obstacles 60 (unconnected to some or all of the other obstacles 60) with spaces 58 between them. In this embodiment the openings 54 and spaces 58 are disposed at different locations to ensure efficient mixing, however the openings 54, 58 may alternatively be positioned at the same locations in each of the solid flow equalizers 30, 32. The barrier 32 may also be unconnected to the side walls 40, 42 of the cooling chambers 23, 25 which allows possible heat expansion to take place. In this case the barrier 32 is not of a cooled structure.

In some cases the first chamber 21 may be provided without a heat exchanger 24 so that the chamber 21 may be used as a dilution zone. This is the case particularly when reacting (combusting) chlorine containing fuel, for example, RDF (Refuse Derived Fuel), or similar waste materials.

Solids from the last chamber 25 (the third chamber in FIG. 2) are drained out via opening 64 at the bottom of the chamber 25. Where the present invention is used as an ash cooler, the solids are conveyed for further processing. However, in some cases solids from outlet 64 may even be returned to the reactor 12. The fluidization velocity in the fluidized bed cooler 20 is maintained at such a rate (e.g. 0.5–2 m/s) that at least a portion of fine particles may be transported back to the reactor with gas via openings 52.

The fluidized bed cooler 20 is preferably constructed as a cooled structure having end and top walls including cooling tubes 62. [Side walls 40, 42—see FIG. 3—also may be cooled.] Preferably the cooling medium flow circuit is common to the reactor 12 and/or separator 14, so that the tubes 62 are in operational connection with respective cooling tubes of the reactor 12 and/or separator 14. Thus, the fluidized bed cooler 20 is integrally associated with the fluidized bed combustor/gasifier having a common cooling system. The common wall 22 includes cooling tubes 65, which tubes have bends 66 at the locations of the openings in the wall 22.

Figure 4:
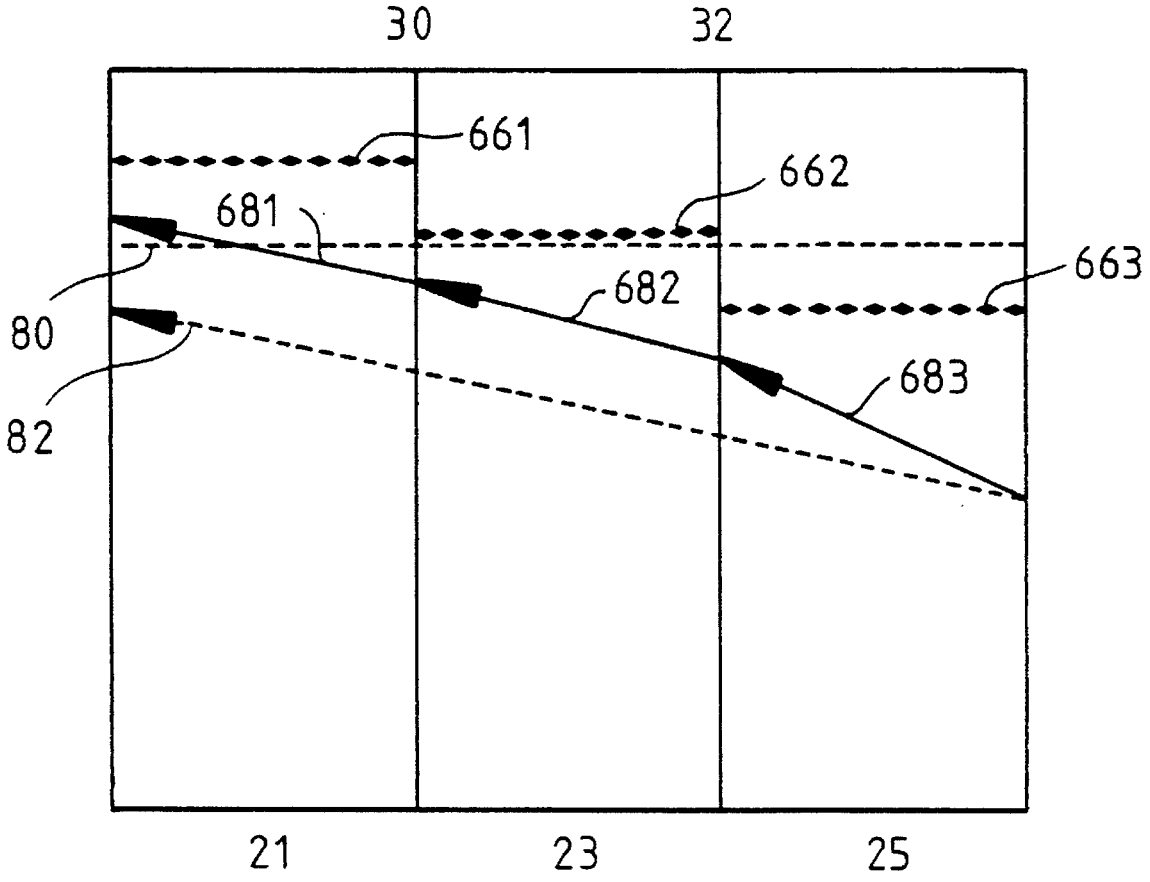
FIG. 4 is a temperature profile graph illustrating an exemplary temperature profile in practicing the method according to the present invention compared to the prior art.

FIG. 4 is a rough temperature graph illustrating the operation of the fluidized bed cooler 20 according to the present invention. This sketch shows the temperature levels of a fluidized bed with three distinct chambers 21, 23, 25. The temperature of the solids in the first chamber 21 is depicted by line 661. The temperature of the bed in the first chamber 21 is substantially equal, which is obtained by the utilization of the present invention. A solid material flow equalizer 30 is provided to border the first and the second chambers 21, 23, which effects a required suppression of solids movement between the chambers 21, 23, thus enabling the development of distinct temperatures in the adjacent chambers 21, 23. Simultaneously, due to equally spaced communication openings 54, 58 in the solid flow equalizers 30, 32, the solid material is efficiently mixed in each of the chambers 21, 23.

The temperature of the solid material in the chambers 21, 23, 25 is staged so that it decreases towards the last chamber 25. Arranging heat exchangers 24, 26, 28 in each chamber to be connected as counter-current heat exchangers, the development of the temperature in the heat exchangers complies with lines 683, 682 and 681 when heating of a medium, e.g. steam or water is in question. Thus, in each chamber 21, 23, 25 the end temperature of the heat transfer medium may be designed to be as close to the solid bed temperature as possible. This results in higher final end temperature 681 of the heat transfer medium in the first chamber 21.

The dotted line 80 illustrates an average temperature of the solids without the assembly of the present invention and also the final end temperature 82 of the heat transfer medium. As can be seen, the present invention provides a considerably higher final end temperature of the heat transfer medium.

Figure 5:
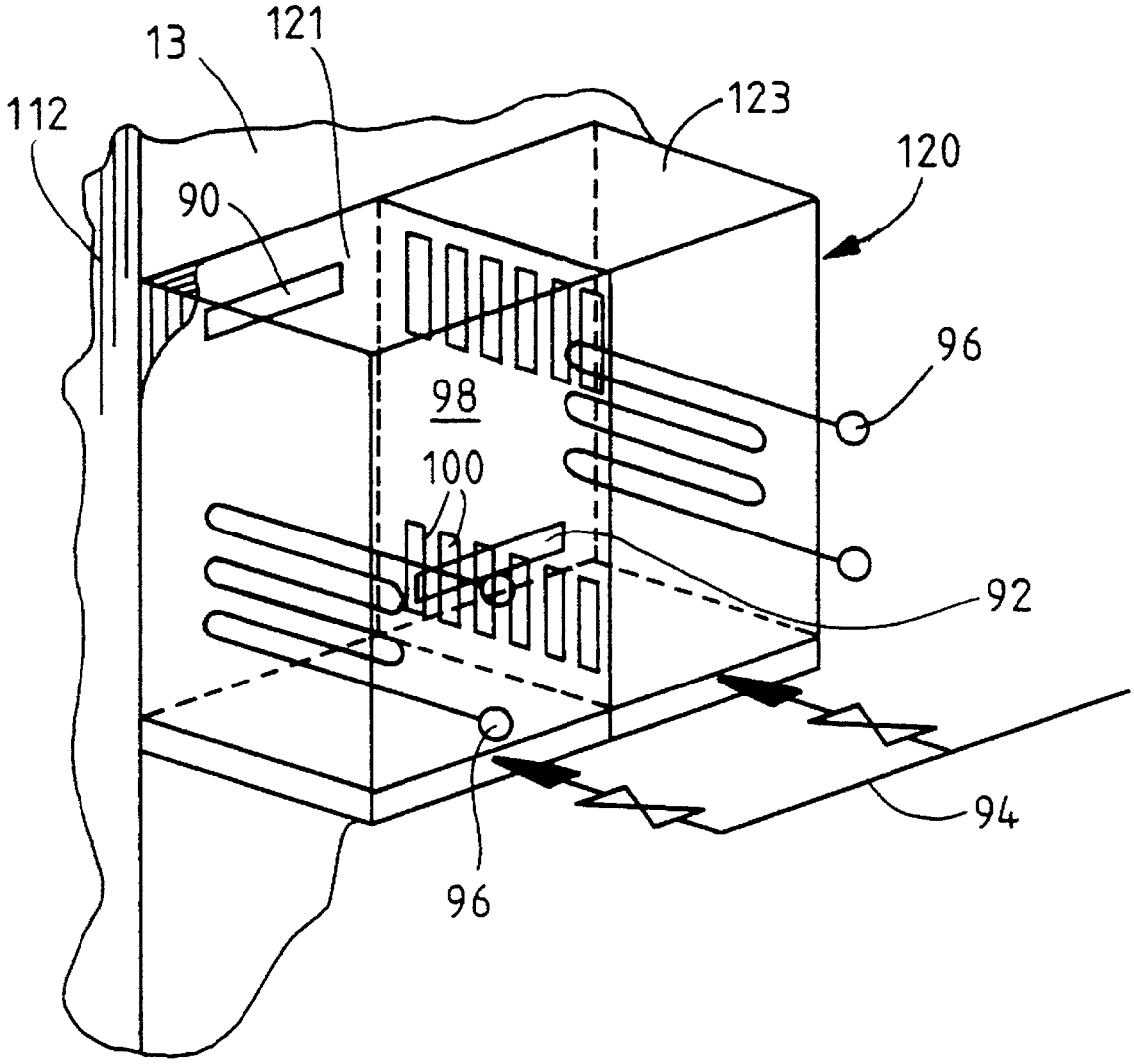
FIG. 5 is a schematic isometric view illustrating another exemplary fluidized bed assembly according to the present invention.

FIG. 5 illustrates an embodiment of the present invention for cooling solid material in a circulating fluidized bed reactor. The fluidized bed cooler 120 is mounted in a side wall 13 of a circulating fluidized bed reactor 112. In this embodiment the chambers 12, 123 are positioned to each share the common wall 13 with the reaction chamber 112, thus the fluidized bed cooler 120 does not extend far from the reactor 112 and saves space around it. An inlet 90 is provided in the first chamber 121 to receive hot solid material from the chamber 112. The opening 90 may also be connected to the return duct (not shown herein). Cooled solids are discharged back to the chamber 112 from the second chamber 123 via outlet 92. The beds in chambers 121,123 are maintained in a fluidized state by means 94 for introducing fluidization gas, and the solids are cooled by heat exchangers 96 in the chambers 121, 123.

The solid flow equalizer 98 is provided to divide the volume of cooler 120 into the chambers 121, 123. Equalizer 98 is provided with vertically oriented substantially equally spaced, slot like openings 100 to allow the passage of the solids from the first chamber 121 to the second chamber 123, thus forming a two staged fluidized bed solid material cooler 120.

Figure 6:
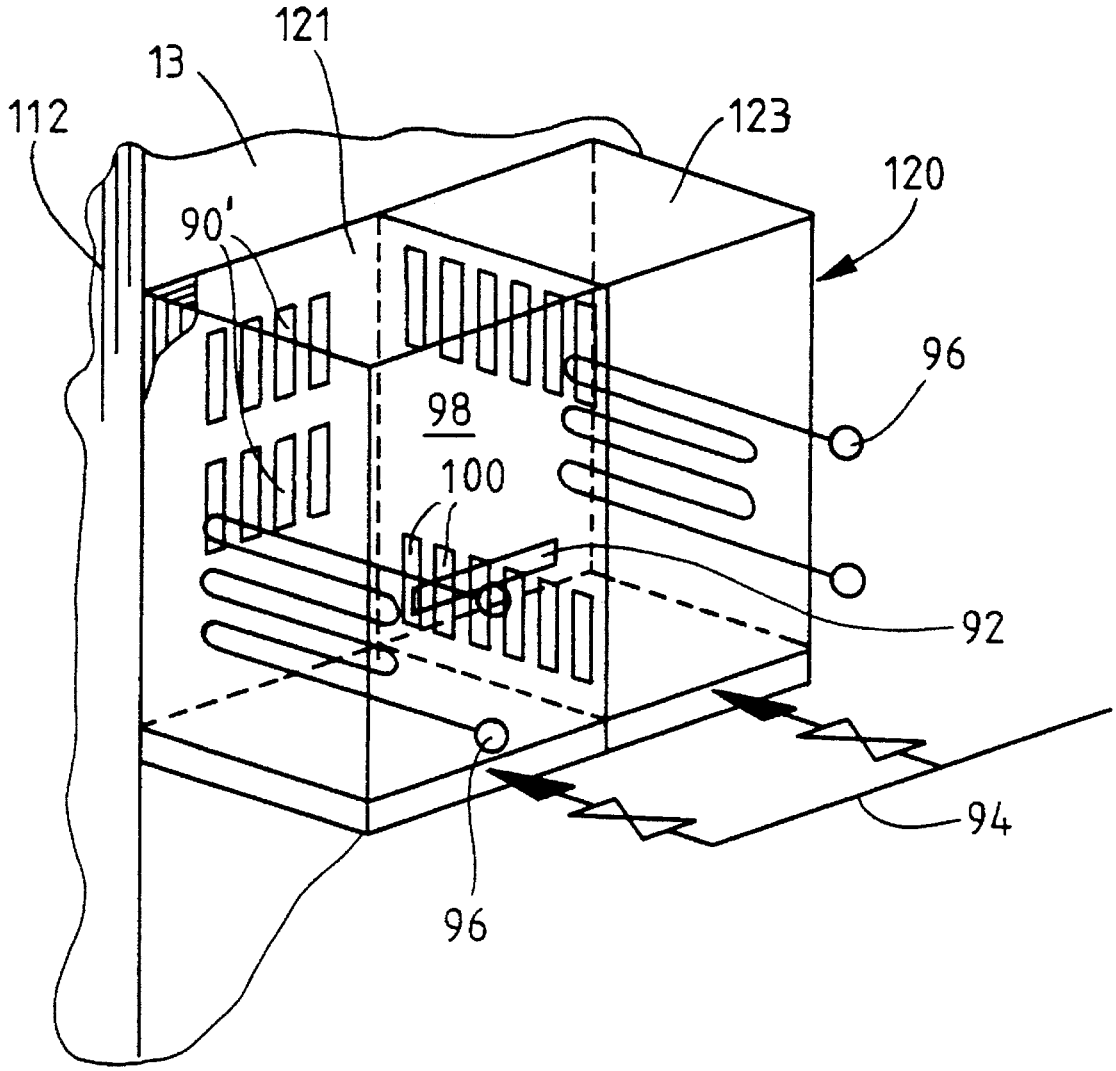
FIG. 6 is a view like that of FIG. 5 of a modified construction.

FIG. 6 shows a construction similar to the one shown in FIG. 5 but the flow equalizer has the openings 90'. In this case the chamber 121 is in direct connection with CFB-reactor (common cooled wall) by means of a flow equalizer (not just an opening as in FIG. 5) so that the operation of chamber 121 will be more efficient when compared to the concept of FIG. 5.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fluidized bed assembly comprising:

a first fluidized bed chamber;

a second fluidized bed chamber;

each of said chambers having a bottom portion, and side walls;

means for introducing fluidizing gas into each of said bottom portions to fluidize particulates in said chambers;

a flow equalizer separating said first and second chambers and providing a substantially uniform passage of particulates from said first chamber to said second chamber; and wherein at least one of said first and second chambers includes heat transfer means immersed in the fluidized bed in said fluidized bed chamber, and means for discharging gas from the fluidized bed chamber.

2. An assembly as recited in claim 1, wherein each of said first and second chambers includes heat transfer means immersed in the fluidized bed in the fluidized bed chamber.

3. An assembly as recited in claim 1, wherein said flow equalizer comprises a barrier with at least two distinct openings spaced a distance from each other which is at its shortest 10–50% of the square root of the surface area of said barrier, the openings in said barriers providing <30% open area of the cross sectional area of said fluidized bed assembly at said barrier.

4. An assembly as recited in claim 1, in combination with a fluidized bed combustor/gasifier, said first chamber connected to a lower portion of the fluidized bed combustor/gasifier, and for receiving ash from said combustor/gasifier; and heat exchangers in said assembly chambers for cooling ash from said combustor/gasifier, and a separator for separating particles above a predetermined size from the ash before it enters said first chamber.

5. A combination as recited in claim 4, wherein said fluidized bed assembly heat exchangers are integrally connected to a common cooling system with the fluidized bed combustor/gasifier.

6. An assembly as recited in claim 1 further comprising a third fluidized bed chamber having a bottom portion and side walls, means for introducing fluidized gas into said third chamber independent of said first and second chambers, and a second flow equalizer separating said second and third chambers and providing a substantially uniform passage of particulates from said second chamber to said third chamber so that no dead spots or corners form in said chamber adjacent said second flow equalizer.

7. A fluidized bed assembly comprising:

a first fluidized bed chamber;

a second fluidized bed chamber;

each of said chambers having a bottom portion, and side walls;

means for introducing fluidizing gas into each of said bottom portions to fluidize particulates in said chambers; and a barrier disposed at an interface between said first and second chambers having N distinct openings therein wherein N is an integer greater than 2, a distance between each of the openings being provided which is 1/N–N/2 of the square root of the surface area of said barrier, and said openings collectively providing less than 30% open area at the interface between said first and second chambers; and wherein said barrier has heat exchange circulating fluid components contained therein.

8. An assembly as recited in claim 7 wherein said barrier comprises a plurality of obstacles with spaces between said obstacles forming said openings, said obstacles and spaces being substantially uniformly spaced.

9. An assembly as recited in claim 7, wherein at least one of said first and second chambers includes heat transfer means immersed in the fluidized bed in said fluidized bed chamber, and means for discharging gas from the fluidized bed chamber.

10. An assembly as recited in claim 9, wherein each of said first and second chambers includes heat transfer means immersed in the fluidized bed in the fluidized bed chamber.

11. A fluidized bed assembly comprising:

a first fluidized bed chamber;

a second fluidized bed chamber;

each of said chambers having a bottom portion, and side walls;

means for introducing fluidizing gas into each of said bottom portions to fluidize particulates in said chambers; and a wall with a plurality of substantially uniformly spaced openings separating said first and second chambers and providing a substantially uniform passage of particulates from said first chamber to said second chamber.

12. An assembly as recited in claim 11 wherein said openings are uniformly spaced both vertically and horizontally, providing a substantially uniform flow rate of particles through each of said openings.

13. An assembly as recited in claim 11 wherein said wall has heat exchange circulating fluid components contained therein.

14. An assembly as recited in claim 11, wherein said wall openings provide <30% open area of the cross sectional area of said fluidized bed assembly at the interface between said first and second chambers.

15. An assembly as recited in claim 11 wherein each said opening largest dimension is <50 mm.

16. An assembly as recited in claim 11, in combination with a fluidized bed combustor/gasifier, said first chamber connected to a lower portion of the fluidized bed combustor/gasifier, and for receiving ash from said combustor/gasifier; and heat exchangers in said assembly chambers for cooling ash from said combustor/gasifier, and a separator for separating particles above a predetermined size from the ash before it enters said first chamber.

17. A combination as recited in claim 16, wherein said fluidized bed assembly heat exchangers are integrally connected to a common cooling system with the fluidized bed combustor/gasifier.

18. An assembly as recited in claim 11 further comprising a third fluidized bed chamber having a bottom portion and side walls, means for introducing fluidized gas into said third chamber independent of said first and second chambers, and a second flow equalizer separating said second and third chambers and providing a substantially uniform passage of particulates from said second chamber to said third chamber so that no dead spots or corners form in said chamber adjacent said second flow equalizer.

19. An assembly as recited in claim 11, wherein at least one of said first and second chambers includes heat transfer means immersed in the fluidized bed in said fluidized bed chamber, and means for discharging gas from the fluidized bed chamber.

20. A fluidized bed assembly comprising:

a first fluidized bed chamber;

a second fluidized bed chamber;

each of said chambers having a bottom portion, and side walls;

means for introducing fluidizing gas into each of said bottom portions to fluidize particulates in said chambers; and a plurality of obstacles with spaces between said obstacles forming a plurality of openings, said obstacles and spaces being substantially uniformly spaced, and separating said first and second chambers and providing a substantially uniform passage of particulates from said first chamber to said second chamber.

21. An assembly as recited in claim 20, wherein said barrier has N distinct openings, where N is an integer greater than 2, having a distance between the openings which is 1/N–½ of the square root of the surface area of said barrier.

22. An assembly as recited in claim 20 wherein each said opening largest dimension is <50 mm.

23. An assembly as recited in claim 20 wherein said plurality of obstacles have heat exchange circulating fluid components contained therein.

24. An assembly as recited in claim 20, wherein said openings provide <30% open area of the cross sectional area of said fluidized bed assembly at the interface between said first and second chambers.

25. An assembly as recited in claim 20 further comprising a third fluidized bed chamber having a bottom portion and side walls, means for introducing fluidized gas into said third chamber independent of said first and second chambers, and a second flow equalizer separating said second and third chambers and providing a substantially uniform passage of particulates from said second chamber to said third chamber so that no dead spots or corners form in said chamber adjacent said second flow equalizer.

26. An assembly as recited in claim 20, in combination with a fluidized bed combustor/gasifier, said first chamber connected to a lower portion of the fluidized bed combustor/gasifier, and for receiving ash from said combustor/gasifier; and heat exchangers in said assembly chambers for cooling ash from said combustor/gasifier, and a separator for separating particles above a predetermined size from the ash before it enters said first chamber.

27. A combination as recited in claim 26, wherein said fluidized bed assembly heat exchangers are integrally connected to a common cooling system with the fluidized bed combustor/gasifier.

28. An assembly as recited in claim 20, wherein at least one of said first and second chambers includes heat transfer means immersed in the fluidized bed in said fluidized bed chamber, and means for discharging gas from the fluidized bed chamber.

29. A fluidized bed assembly comprising:

a first fluidized bed chamber;

a second fluidized bed chamber;

each of said chambers having a bottom portion, and side walls;

means for introducing fluidizing gas into each of said bottom portions to fluidize particulates in said chambers; and a barrier separating said first and second chambers and providing a substantially uniform passage of particulates from said first chamber to said second chamber, said barrier having at least two distinct openings spaced a distance from each other which is at its shortest 10–50% of the square root of the surface area of said barrier, the openings in said barriers providing <30% open area of the cross sectional area of said fluidized bed assembly at said barrier.

30. An assembly as recited in claim 29 wherein said barrier has heat exchange circulating fluid components contained therein.

* * * * *